US009364864B2

(12) United States Patent
Paul et al.

(10) Patent No.: US 9,364,864 B2
(45) Date of Patent: Jun. 14, 2016

(54) TROMMEL ASSEMBLY

(71) Applicant: TEGA INDUSTRIES LIMITED, Kolkata, West Bengal (IN)

(72) Inventors: Biswadeep Paul, West Bengal (IN); Debashis Koley, West Bengal (IN); Tanmay Moharana, West Bengal (IN); Gopi Charan Chaudhary, West Bengal (IN)

(73) Assignee: TEGA INDUSTRIES LIMITED, Kolkata (IN)

( * ) Notice: Subject to any disclaimer, the term of this patent is extended or adjusted under 35 U.S.C. 154(b) by 0 days.

(21) Appl. No.: 14/419,834

(22) PCT Filed: Jan. 24, 2013

(86) PCT No.: PCT/IN2013/000050
§ 371 (c)(1),
(2) Date: Feb. 5, 2015

(87) PCT Pub. No.: WO2014/024204
PCT Pub. Date: Feb. 13, 2014

(65) Prior Publication Data

US 2015/0165482 A1 Jun. 18, 2015

(30) Foreign Application Priority Data

Aug. 6, 2012 (IN) ..... 890/KOL/2012

(51) Int. Cl.

| | |
|---|---|
| ***B07B 1/18*** | (2006.01) |
| ***B07B 1/46*** | (2006.01) |
| ***B07B 1/22*** | (2006.01) |

(52) U.S. Cl.
CPC ..... *B07B 1/4645* (2013.01); *B07B 1/18* (2013.01); *B07B 1/22* (2013.01); *B07B 1/4618* (2013.01); *B07B 1/4627* (2013.01); *Y10T 29/49826* (2015.01); *Y10T 29/49963* (2015.01)

(58) Field of Classification Search
CPC ..... B07B 1/185; B07B 1/22; B07B 1/24; B07B 1/4618; B07B 1/4645
See application file for complete search history.

(56) References Cited

U.S. PATENT DOCUMENTS

| | | | | | |
|---|---|---|---|---|---|
| 108,246 | A | * | 10/1870 | Fickinger | B07B 1/22 209/235 |
| 1,182,680 | A | * | 5/1916 | Heimngs | B07B 1/22 209/291 |
| 1,284,669 | A | * | 11/1918 | Haug | D21F 1/60 162/357 |
| 1,717,604 | A | | 6/1929 | Haug et al. | |

(Continued)

FOREIGN PATENT DOCUMENTS

| | | | |
|---|---|---|---|
| DE | 19540982 | A1 | 6/1997 |
| EP | 1582271 | A1 | 10/2005 |

(Continued)

OTHER PUBLICATIONS

International Search Report issued in PCT/IN2013/000050 mailed Jun. 10, 2013 (5 pages).

*Primary Examiner* — Joseph C Rodriguez
(74) *Attorney, Agent, or Firm* — Winstead PC

(57) ABSTRACT

An improved trommel assembly (1) for screening different particles, comprising a plurality of modular units (2) detachably attached to one another, each modular unit having a flange (3) adapted to firmly attach with one or more corresponding flanges (3) of one or more corresponding modular units (2).

8 Claims, 8 Drawing Sheets

(56) References Cited

Figure 1A:
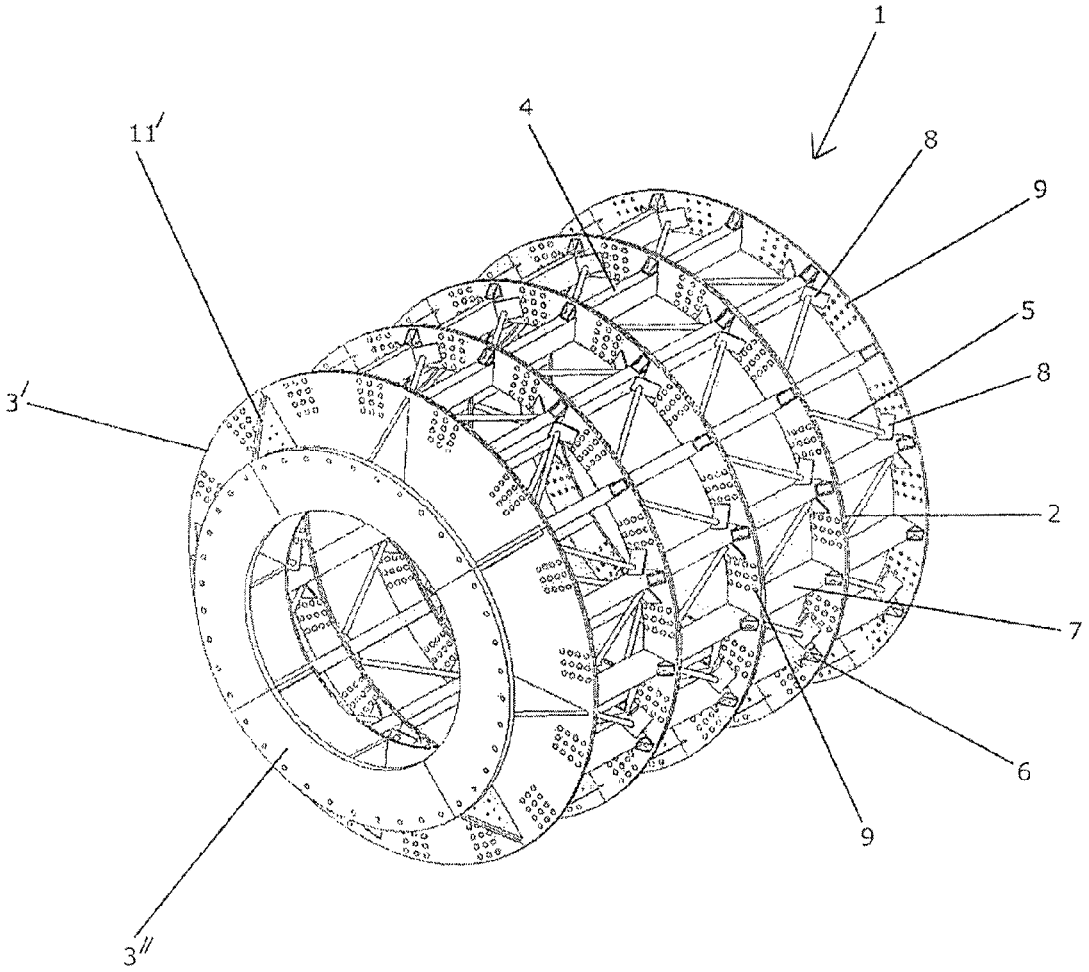

U.S. PATENT DOCUMENTS 1,771,996 A * 8/1930 Chapman ..... B07B 1/22 209/284
2,204,835 A * 6/1940 Eisenhand ..... B07B 1/18 209/399
4,018,675 A * 4/1977 Petrucci ..... B03B 9/06 209/295
4,119,534 A * 10/1978 Porter ..... B07B 1/22 209/291
4,184,944 A * 1/1980 Tytko ..... B07B 1/24 209/288
4,312,749 A * 1/1982 Bingham ..... B03B 5/56 209/298
5,507,396 A * 4/1996 Hauch ..... B07B 1/18 209/290
6,050,423 A * 4/2000 Dunnuck ..... B07B 1/185 209/363
6,360,894 B1 * 3/2002 Devlin ..... B07B 1/22 209/291
7,513,370 B2 * 4/2009 Fridman ..... B07B 1/005 209/241
7,735,656 B1 6/2010 Bassler
7,896,270 B2 * 3/2011 Sharp ..... B02C 17/002 241/235
8,245,962 B2 * 8/2012 Didion ..... B02C 17/002 241/251
2005/0139524 A1 * 6/2005 Douglas ..... B07B 1/22 209/287
2007/0074998 A1 4/2007 Langner
2013/0240652 A1 * 9/2013 Gardner ..... B07B 1/185 241/89.1
2015/0165482 A1 * 6/2015 Paul ..... B07B 1/18 209/288
2015/0231668 A1 * 8/2015 Bosco De Barros ..... B07B 9/00 209/22

FOREIGN PATENT DOCUMENTS

WO 00/64600 A1 11/2000
WO 2008/116245 A1 10/2008

* cited by examiner

TROMMEL ASSEMBLY

CROSS REFERENCE TO RELATED APPLICATIONS

This application is a national stage entry of PCT/IN2013/000050, filed on Jan. 24, 2013, which claims priority from Indian Application No. 890/KOL/2012, filed on Aug. 6, 2012.

FIELD OF THE INVENTION

The present invention in general relates to a trommel screen assembly and more particularly to an improved trommel screen assembly comprising modular screen assembly of substantially less weight which is scalable, easy to transport and easy to assemble.

BACKGROUND OF THE INVENTION

A trommel (from the german word for drum), is a screened cylinder used to separate materials by size—for example, separating the biodegradable fraction of mixed municipal waste or separating different sizes of crushed stone.

Trommels or revolving screen is one of the oldest screening devices, which is a cylindrical screen typically rotating at between 35% and 45% critical speed. Trommels are installed on a small angle to the horizontal or use a series of internal baffles to transport material along the cylinder. Trommels can be made to deliver several sized products by using trommel screens in series from finest to coarsest.

Portable trommels (also called portable trommel screens) are often used in the production of organic products from various types of waste.

For example, excavation contractors may screen their site debris into two fractions; a saleable topsoil for farms, nurseries and site-work, as well as cleaned rock for aggregates or landscaping work. This allows the contractor to resell their waste, instead of incurring the cost of sending it for disposal.

Trommels remain widely used in some screening duties including aggregate screening plants and the screening of mill discharge streams. AG, SAG, and ball mill discharge streams. AG, SAG, and ball mill discharge streams usually pass through a trommel screen attached to the mill outlet to prevent ball scats from reaching subsequent processing equipment and to prevent a build-up of pebbles in the mill.

Though the use of trommel in several industries like gold mine or separating biodegradable in wash plants is common in art, however, those available have been found complicated and expensive as well and difficult to transport due to its heavy weight. As a result, many obstacles come across during transportation through shipping by water or by air.

Accordingly, there is a long felt need to provide an improved trammel assembly which is scalable, easy to transport and easy to assemble is of substantially low weight and simultaneously is technically sacrosanct.

The present invention meets the abovementioned long felt needs.

OBJECTS OF THE INVENTION

It is the principal object of the present invention to provide an improved modular trommel assembly, which is scalable, easy to transport and easy to assemble, is of substantially low weight and is simultaneously technically sacrosanct.

It is another object of the present invention to provide an improved modular trommel assembly which ensures that the stresses and displacements in structural elements are within limits.

How the foregoing objects are achieved and the other aspects of the present invention will be clear from the following description, which is purely by way of understanding and not by way of any sort of limitation.

SUMMARY OF THE INVENTION

Accordingly, the present invention provides an improved trommel assembly for screening different particles, comprising a plurality of modular units detachably attached to one another, each modular unit having a flange adapted to firmly attach with one or more corresponding flanges of one or more corresponding modular units.

In accordance with preferred embodiments of the trommel assembly of the present invention:

- said flange of one modular unit is attached to a corresponding flange of another said modular unit by plates or channel sections using suitable fixing media such as herein described, said plates or channel sections being located at the ends of each said modular unit and said flanges having holes arranged in an array, for facilitating joining to a corresponding flange of another module;
- there exists a plurality of beam members and cross members between every two said flanges, said beam members acting as the main load carrying members and said cross members being adapted to take up and distribute the stresses and comprise different types of sections;
- plates are applied to fix said cross members to said flanges and to said beam members, two ends of each said cross member and each said beam member being attached to a flange body at either end;
- said plates are chamfered plates of certain sizes which are welded to the beam member and flange surfaces using standard welding procedures so that the overall rigidity of the structure remains intact;
- an assembly of ribs and angles are welded together to fix said beam member to said flanges;
- every two said ribs are welded to a said angle, said beam members being welded together on to said angle, said beam members being fixed to said flanges by welding;
- there exists a modular transition piece for joining of said trommel structure to the mill discharge face applying suitable fixing media such as bolted connections, said transition piece having a front flange and also ribs for allowing transfer of load from said trommel structure to the mill discharge face, through said bolted connections;
- modular trommel screen panels made of polyurethane or rubber are also fixed on the inner side of said assembly to complete the structure and make it operational.

BRIEF DESCRIPTION OF THE ACCOMPANYING DRAWINGS

Figure 1B:
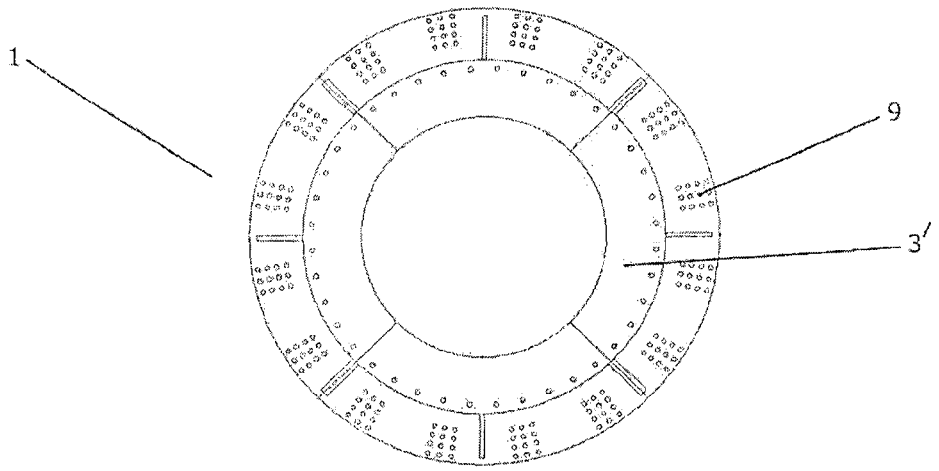
Figure 1C:
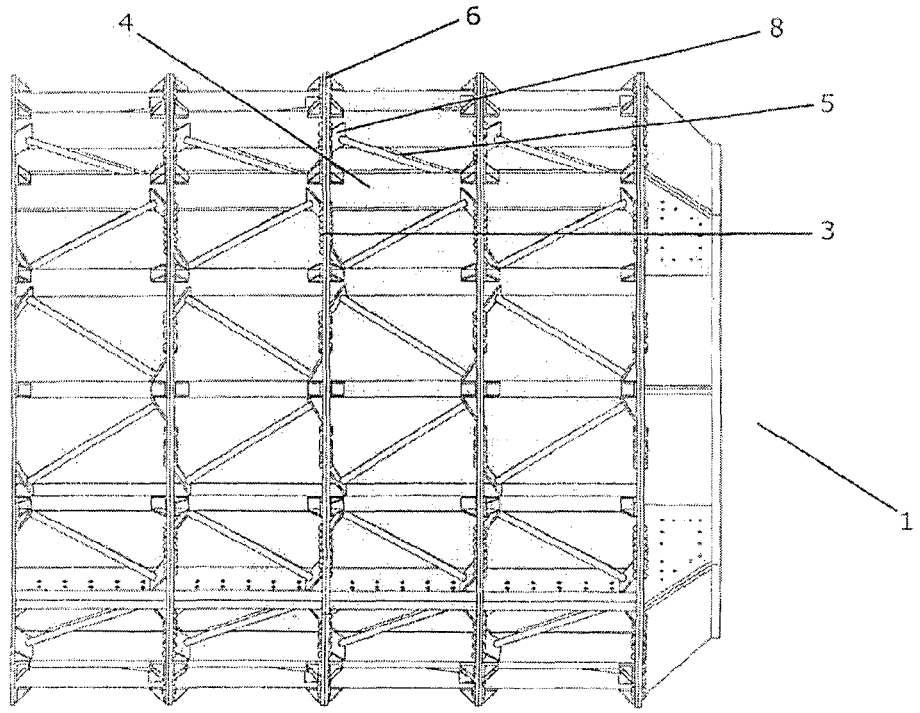

The nature and scope of the present invention will be better understood from the accompanying drawings, which are by way of illustration of a preferred embodiment and not by way of any sort of limitation. In the accompanying drawings, FIGS. 1*a*, 1*b* and 1*c* illustrate the isometric, front view and side view respectively of a preferred embodiment of the modular trommel assembly in accordance with the present invention.

Figure 2A:
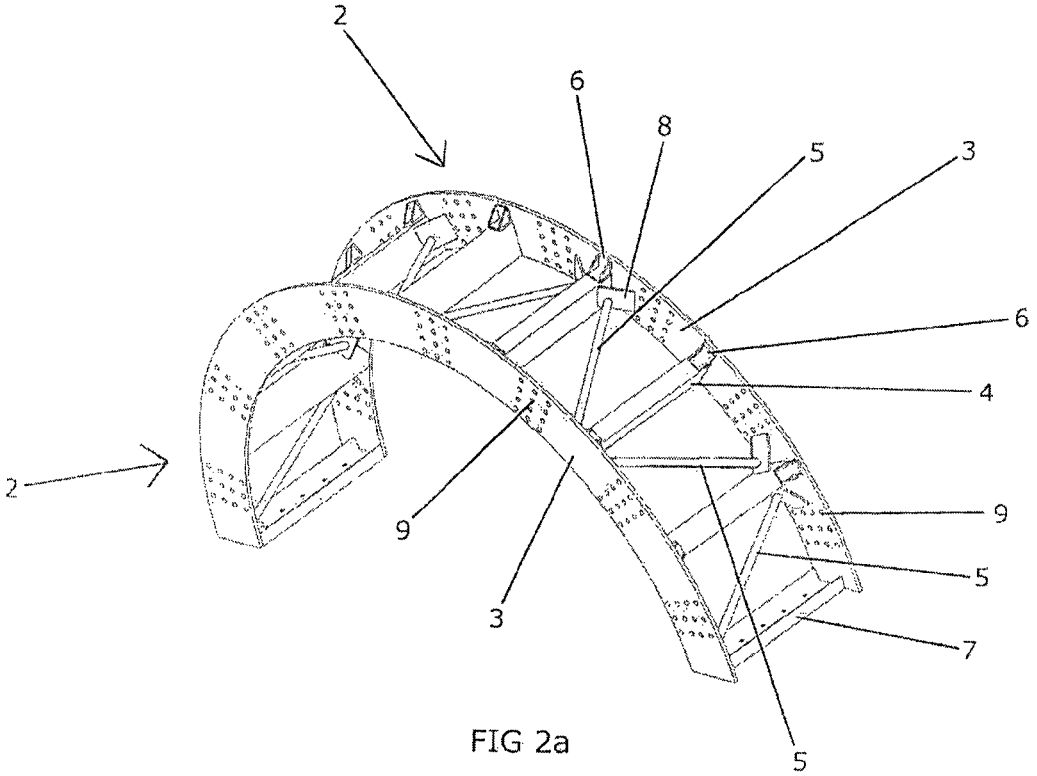
Figure 2B:
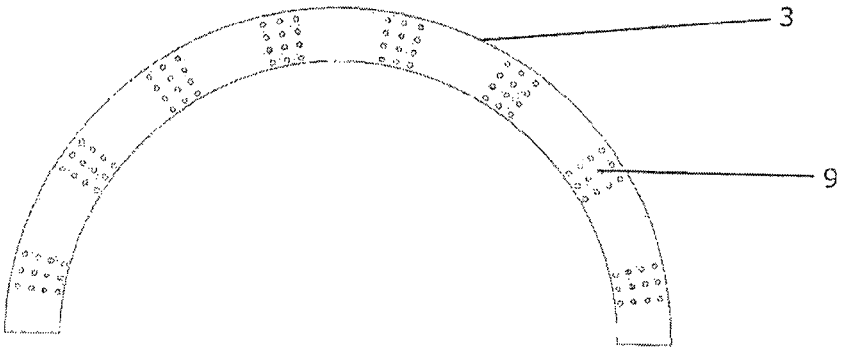
Figure 2C:
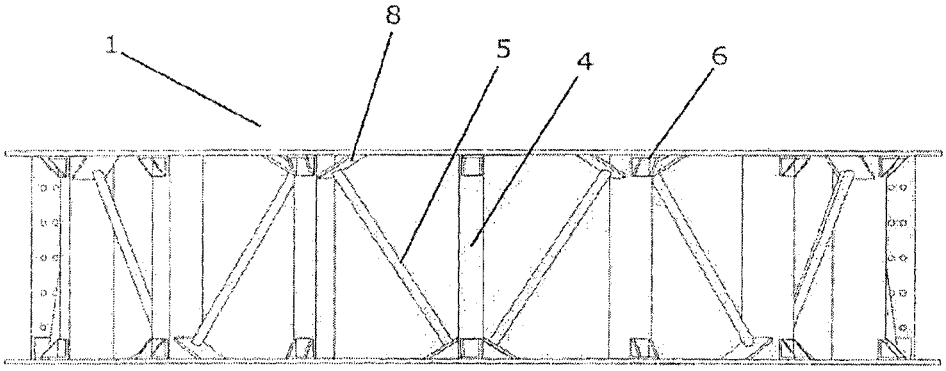

FIGS. 2*a*, 2*b* and 2*c* illustrate the isometric, front view and top view respectively of the 180 degree section module unit of the modular trommel assembly.

Figure 3A:
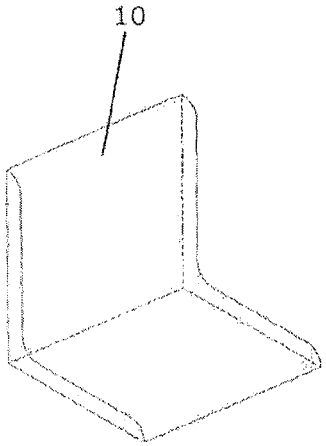
Figure 3B:
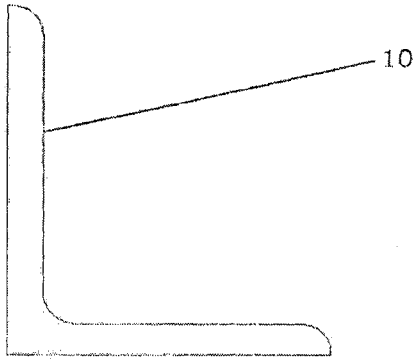

FIGS. 3*a* and 3*b* are the isometric and front view respectively of the angle section of the trommel assembly.

Figure 4A:
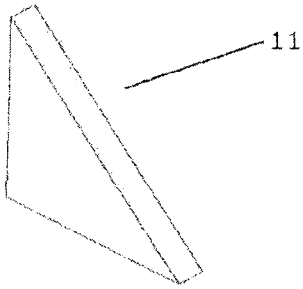
Figure 4B:
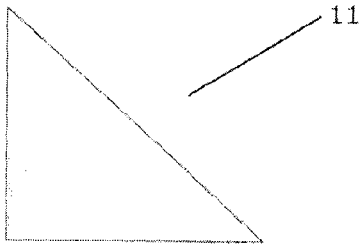

FIGS. 4*a* and 4*b* illustrate the isometric and front view respectively of the rib of the trommel assembly.

Figure 5A:
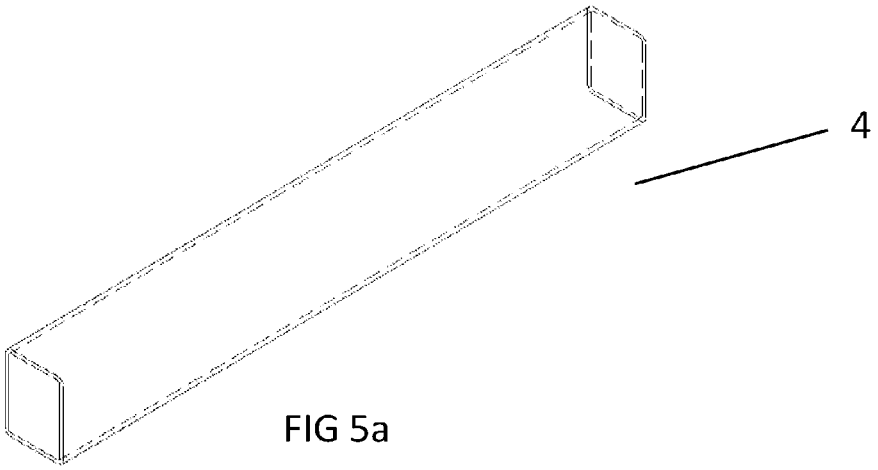
Figure 5B:
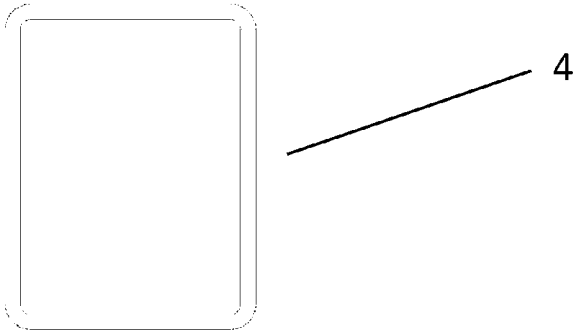

FIGS. 5*a* and 5*b* illustrate the isometric and front view respectively of the Load carrying member or beam section of the trommel assembly.

Figure 5C:
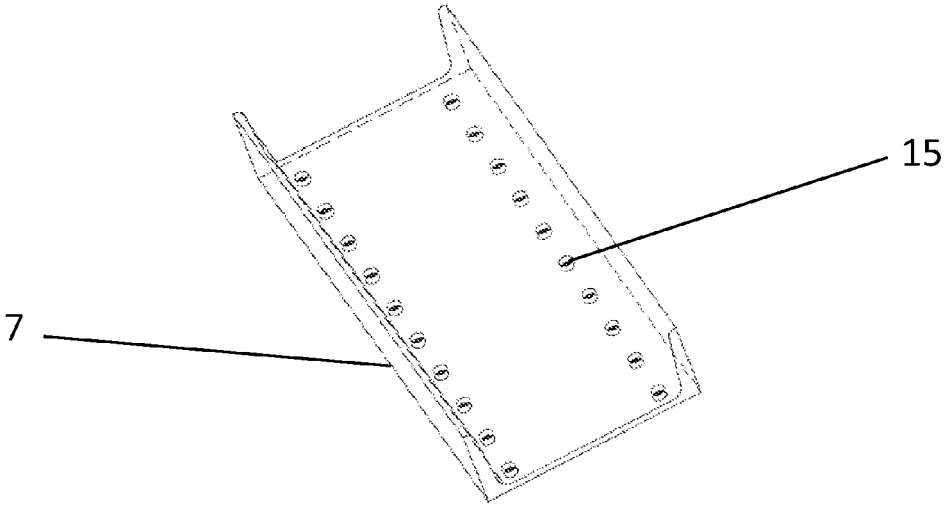

FIGS. 5*c* is the isometric view of the channel section of the trammel assembly.

Figure 5D:
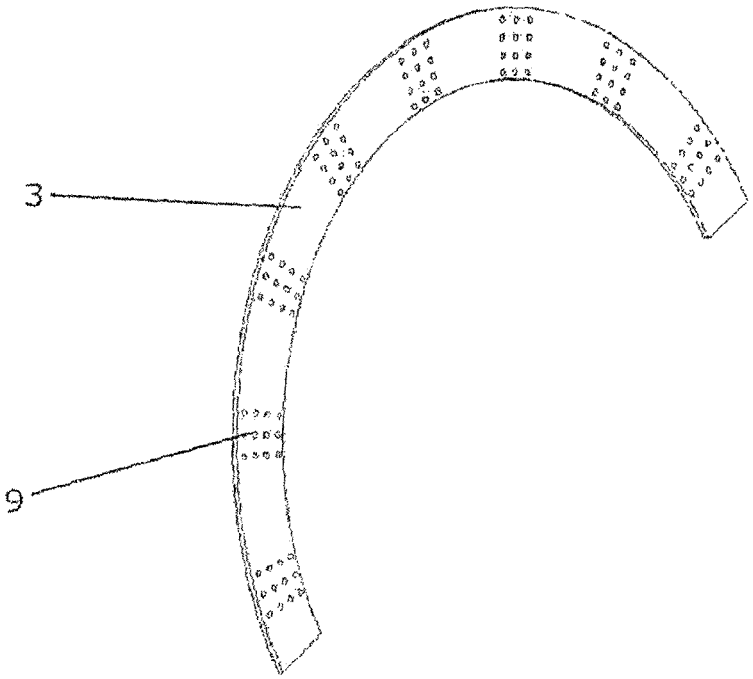

FIG. 5*d* is the isometric view of the Flange of the trommel assembly.

Figure 6:
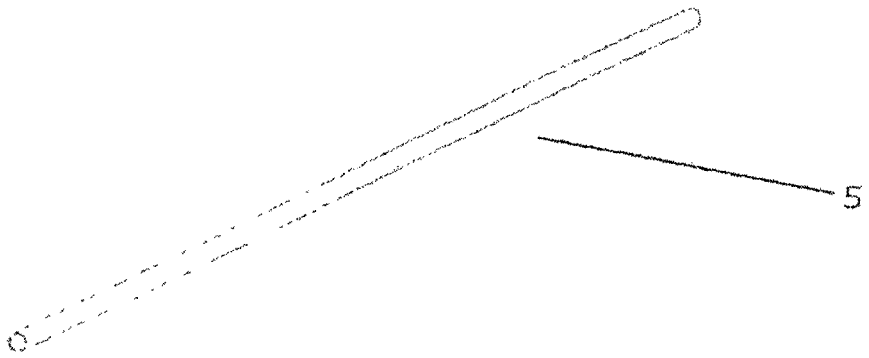

FIG. 6 is the isometric view of the cross member of the trommel assembly.

Figure 7A:
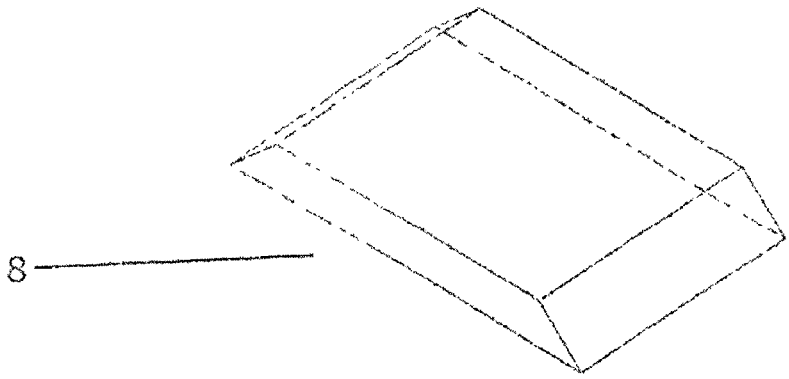
Figure 7B:
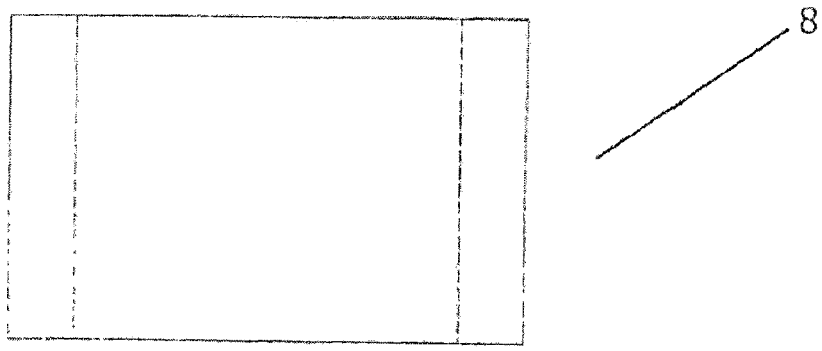

FIGS. 7*a* and 7*b* illustrate the isometric and top view respectively of the chamfer plates of the trommel assembly.

Figure 8A:
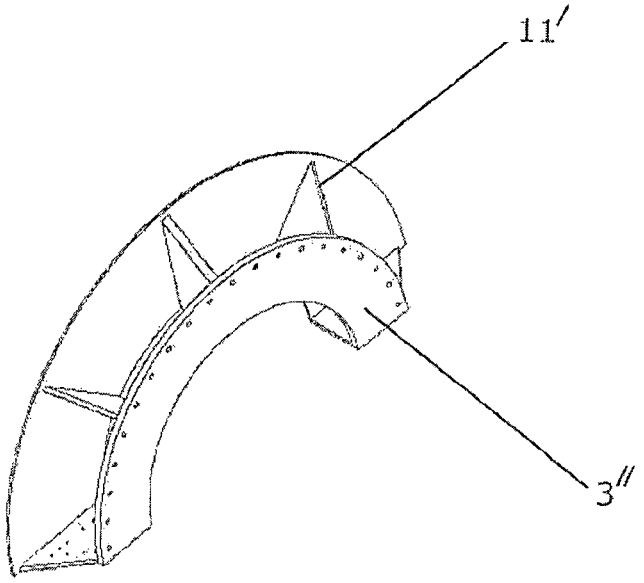
Figure 8B:
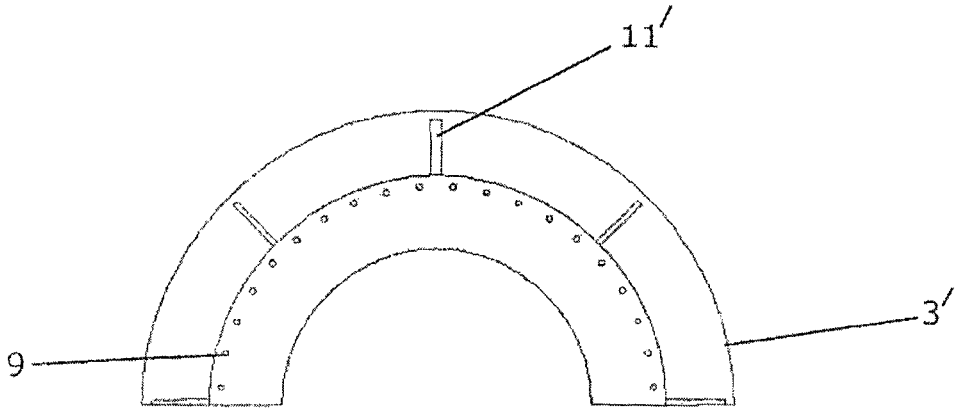

FIGS. 8*a* and 8*b* illustrate the isometric and front view respectively of the segmented transition pieces of the trommel assembly.

DETAILED DESCRIPTION OF THE INVENTION

The following describes a preferred embodiment of the present invention, which is purely for the sake of understanding the present invention and not by way of any sort of limitation.

The trommel assembly in accordance with the present invention comprises of modular units for achieving its desired objectives, as narrated under the heading "Objects of the Invention"

In all the figures like reference numerals represent like features. The figures are now being referred to one after another for the purpose of explaining the invention.

According to the invention, the whole trommel assembly as shown in FIGS. 1*a*, 1*b* & 1*c* is being made by assembling several numbers of the modular section unit (2) best shown in FIG. 2*a*. The unit (2) can be of different sizes and comprises of different dimensions of elements. Several such units (2) with its elements are all suitably fixed to form the modular trommel assembly according to the present invention. Each modular element (2) comprises plurality of elements in different configurations and size for the structural rigidity of the whole trommel assembly (1).

FIG. 1*a* illustrates a perspective view of such a modular trommel assembly, while FIG. 1*b* illustrate front view and side view respectively of such assembly.

Now, how the modular units (2) and its various parts are connected is now explained with reference to the subsequent figures.

First of all FIG. 2*a* is being referred to, which illustrates a 180° section of a basic modular unit (2) of the present invention, each unit comprising of a flange (3). To be precise, FIG. 2*a* shows at least two such flanges (3) joined together. A plurality of each unit (2), are actually assembled to form the trommel structure.

FIG. 2*b* is a front view of the unit shown in FIG. 2*a*, while FIG. 2*c* is a top view of the same.

Each modular unit (2) consists of a flange (3) which can be of different thickness depending on the size and length of the whole trommel structure. The flange (3) has holes (9) arranged in an array in them so that they can be joined to a corresponding flange (3) of another module (2) using suitable fixing-media, to form the trommel assembly. The fixing media may be different kinds of bolts, rivets and locking systems for fixing two or more parts together. All the fixing media are tested for strength and fatigue limits for safe functioning of the parts and the whole structure. FIG. 5*d* shows the flange (3) of each modular unit (2) in greater detail. Flanges, which can be made of any structural material is an important and integral part of each modular unit (2).

As shown in FIG. 2*a* there exist beam sections (4) between every two flanges (3) as the main load carrying members and the cross members (5) between two such flanges (3) take up the stresses and distribute them and can comprise of different types of sections. FIG. 5*a* shows a perspective view of a beam section (4) in greater detail, while FIG. 5*b* shows a front view thereof. FIG. 6 shows a perspective view of a cross member (5).

The Load carrying members (4) can be any kind of beam elements of the variable dimensions depending upon the application. Similarly, the cross members (5) which help out in distribution of the stresses and keeping the structure intact, can be of different dimensions depending on the structure of the trommel.

Coming back to FIG. 2*a* again, it can be seen that plates (8) are applied to fix the cross members (5) to the flanges (3) and to the beams or load carrying members (4). The two ends of each cross member (5) and each beam (4) are attached to a flange (3) body at either end. The plates (8) can be chamfered plates of certain sizes which are welded to the beam (4) and flange (3) surfaces using standard welding procedures so that the overall rigidity of the structure remains intact. FIG. 7*a* illustrates a perspective view of such a chamfered plate (8), while FIG. 7*b* illustrates a top view thereof.

As shown in FIG. 2*a*, two flanges (3) of two modular sections (2) are joined by plates or channel sections (7). These are located at the ends of each unit (2). These plates (7), thus facilitate joining of two different modules (2) using suitable fixing media as described hereinbefore. FIG. 5*c* is an isometric view of such channel section or plate (7), which comprises drilled holes (15) for allowing fixing of two or more modular sections (2).

The portion represented by reference numeral 6 in FIG. 2*a* is an assembly of ribs and angle welded together, to fix the load carrying beams (4) to the flanges (3). As shown in detail in FIGS. 4*a* and 4*b*, this unit (6) consists of two ribs (11). These ribs (11) are welded to the angle (10) shown in FIGS. 3*a* & 3*b*. It is this angle (10), on to which the beam sections (4) are welded together, following standard procedures which again is fixed to the flanges (3) using welding.

Now coming back to FIG. 1*a* and also FIGS. 8*a* and 8*b*, it can be seen that the transition piece (3') is also modular and after being fixed together using suitable fixing media it helps in joining of the trommel structure to the mill discharge face using bolts. The front flange (3"), which is best shown in FIGS. 1*a* and 8*a* is a part of the transition piece (3') of the trommel assembly according to the present invention. The ribs (11') of the transition piece (3') or part can be of any structural material and allows the transfer of load from the trommel structure (1) to the mill discharge face, through the bolted connections.

The modular trommel assembly thus functions on being fixed to the mill ends as usual rotates with the mill and functions effectively to do screening of different particle size ranges depending upon the size of the aperture on the trommel screen panels. The assembly is light weight and achieves the desired objectives of the present invention.

The objects of the present invention are thus achieved by fixing together different identical modular units to make up a trommel assembly, which is then fixed to the mill end.

The different elements or parts of the module is constructed using different materials of construction like stainless steel, mild steels etc.

Modular trommel screen panels made of polyurethane or rubber are also fixed on the inner side of the trommel to complete the structure and make it operational. The fixing of the panels can be of different arrangement like button type fixing or bolt-down fixing etc.

Number of modules can be put together inside a transport container/truck/van etc and then shipped to desired site location where it can be held using cranes or other support mechanism then put together using the fixing-media. Then the whole structure can then be fixed onto the mill discharge using bolts.

If any of the modules get damaged, then, according to the present invention, instead of changing the whole trommel only the damaged module needs to be changed resulting in saving the customers' time and money.

From the description hereinbefore and from the claims it would be clear that all objectives of the invention are achieved.

The present invention has been described with reference to some drawings and a preferred embodiment, purely for the sake of understanding and not by way of any limitation and the present invention includes all legitimate developments within the slope of what has been described herein before and claimed in the appended claims.

The invention claimed is:

1. A trommel assembly for screening particles of varying sizes, the trommel assembly comprising:

a plurality of modular units, each modular unit of the plurality of modular units comprising:

a first flange;

a second flange;

a plurality of beam members, wherein each beam member of the plurality of beam members comprises a first end coupled to the first flange and a second end coupled to the second flange;

a plurality of cross members, wherein each cross member of the plurality of cross members comprises two ends;

wherein at least one end of a first cross member and a first end of a first beam member are coupled to the first flange via a first plate and at least another end of the first cross member and a second end of a second beam member are coupled to the second flange via a second plate; and wherein each flange of the first and second flanges comprises holes adapted to allow the first and second flanges to be coupled utilizing one or more threaded couplers; and wherein the trommel assembly is constructed by joining the plurality of modular units.

2. The trommel assembly as claimed in claim 1, wherein the plurality of beam members function as load carrying members.

3. The trommel assembly as claimed in claim 1, wherein:

the first and second plates are chamfered plates;

wherein the first plate is welded to the first end of the first beam member and a surface of the first flange;

wherein the second plate is welded to the second end of the second beam member and a surface of the second flange.

4. The trommel assembly as claimed in claim 1, wherein a plurality of ribs and angles are welded together to couple the plurality of beam members to at least one of the first flange and the second flange.

5. The trommel assembly as claimed in claim 4, wherein at least two ribs of the plurality of ribs are welded to at least one angle of the plurality of angles.

6. The trommel assembly as claimed in claim 1 further comprising:

a modular transition piece, wherein the modular transition piece is configured to join at least one of the plurality of modular units to a mill discharge face; and wherein the modular transition piece comprises a front flange and at least one transition rib allowing transfer of load from least one of the plurality of modular units to the mill discharge face.

7. A method comprising:

providing a plurality of modular trommel units, the plurality of modular trommel units adapted to screen particles of different sizes, the plurality of modular trommel units including a generally cylindrical body and a flange at each end of the cylindrical body;

wherein each modular trommel unit of the plurality of modular trommel units comprises a first flange and a second flange;

coupling, utilizing a plurality of beam members and a plurality of cross members, the first flange to the second flange;

wherein each flange of the first and second flanges comprises holes adapted to allow the first and second flanges to be coupled utilizing one or more threaded couplers;

coupling at least one of the plurality of modular trommel units to a mill discharge;

wherein at least one end of a first cross member of the plurality of cross members and a first end of a first beam member of the plurality of beam members are coupled to the first flange via a first plate and at least another end of the first cross member of the plurality of cross members and a second end of a second beam member of the plurality of beam members are coupled to the second flange via a second plate; and joining the plurality of modular trommel units to construct a trommel assembly.

8. The trommel assembly as claimed in claim 1, wherein the plurality of cross members are configured to distribute structural stress.

* * * * *